US006007288A

United States Patent [19]

Maffett et al.

[11] Patent Number: 6,007,288

[45] Date of Patent: Dec. 28, 1999

[54] WATERCRAFT STORAGE SYSTEM

[76] Inventors: William C. Maffett, 6 S. Madison Ave.; Brian D. Maffett, 740 Proffitt Hill Dr., both of Cookeville, Tenn. 38501

[21] Appl. No.: 09/016,471

[22] Filed: Jan. 30, 1998

[51] Int. Cl.[6] ..... B65G 1/04

[52] U.S. Cl. ..... 414/281; 414/254; 414/264; 414/260; 414/255

[58] Field of Search ..... 414/254, 281, 414/282, 283, 277, 264, 261, 255, 256, 259, 260; 114/44; 254/4 R, 4 C; 405/3; 212/319, 327

[56] References Cited

U.S. PATENT DOCUMENTS

| | | | |
|---|---|---|---|
| 3,385,458 | 5/1968 | Gresham . | |
| 3,802,580 | 4/1974 | Castaldi . | |
| 4,070,979 | 1/1978 | Otis et al. | 114/263 |
| 4,190,013 | 2/1980 | Otis et al. | 114/263 |
| 4,640,214 | 2/1987 | Bruns | 114/263 |
| 4,726,316 | 2/1988 | Bruns | 114/263 |
| 4,787,804 | 11/1988 | Edenas | 414/281 |
| 4,797,055 | 1/1989 | Tworoger et al. | 414/283 |
| 4,953,488 | 9/1990 | Heidtmann | 114/44 |
| 4,971,505 | 11/1990 | Sawyer | 414/232 |
| 4,979,869 | 12/1990 | Mullin, Jr. | 414/786 |
| 5,011,357 | 4/1991 | Studler | 414/264 X |
| 5,238,348 | 8/1993 | Reimer | 414/254 |
| 5,487,636 | 1/1996 | Mkrtchyan | 414/286 |

FOREIGN PATENT DOCUMENTS

| | | | |
|---|---|---|---|
| 2-88853 | 3/1990 | Japan | 414/254 |
| 3-119270 | 5/1991 | Japan | 414/254 |
| 882343 | 11/1961 | United Kingdom | 414/254 |

OTHER PUBLICATIONS

Brochure *Marinas and Small Craft Harbors* authored by Tobiasson and Kollmeyer, published by Van Nostrand Reinhold, NY.

*Primary Examiner*—Frank E. Werner
*Attorney, Agent, or Firm*—Lucian Wayne Beavers; Waddley & Patterson

[57] ABSTRACT

A system for moving watercraft for storage inside a dry stack watercraft storage facility. The system includes a frame assembly, a cradle assembly and a rack assembly which closely interact with each other to precisely and securely position and protect watercraft stored inside the facility. The cradle assembly lifts a watercraft from the watercraft's center of gravity to position in the rack assembly. The rack assembly supports the watercraft through a pair of cantilever beams, and further includes a pair of cable guides used to guide the cradle assembly in the placement of the watercraft on the cantilever beams and to reduce the sway present during the positioning of the watercraft. The frame assembly supports and protects the other assemblies.

27 Claims, 9 Drawing Sheets

WATERCRAFT STORAGE SYSTEM

BACKGROUND OF THE INVENTION

The present invention relates generally to a watercraft storage system. More particularly, this invention pertains to a dry stack watercraft storage system that uses a cradle assembly integrally with a rack assembly for depositing and retrieving watercraft within a protective housing.

Those skilled in the design and operation of dry watercraft storage systems recognize the need for implementing safer and more efficient dry watercraft storage systems. The present invention is a solution to this need in that a better storage system is built by integrating a standard bridge-crane loading system with a stack-rack system of storing boats. Many of the previous designs of dry boat storage use rack fork-lift systems that have limited stacking capabilities. At heights of over 40 feet, these systems become dangerous and unstable. Therefore, they are typically limited to stacking no more than four boats. Furthermore, they require a concrete ramp system, or a pre-lift conveyor or hoist system, which are impractical or even impossible to employ on bodies of water with high amounts of fluctuation. Other designs, like that disclosed in U.S. Pat. No. 4,070,979, use a fork-lift and have a higher stacking area, yet they require some type of elevating device such as a telescopic mast to be installed to position boats, and in addition to the elevating device, they require an added module to rotate the boat 180 degrees. Further disadvantages of using fork-lift systems include their expense, frequent breakdowns, and need for highly skilled operators in order to function properly.

Another design for boat storage is illustrated in U.S. Pat. No. 3,385,458, which lifts boats via an overhead hoist mechanism and slings. While this design provides for lifting boats without a fork-lift, the usefulness of this design is limited due to the minimal level of stacking available with the required honeycomb-type storage stack (no more than three boats stacked) as well as the difficulty of positioning the slings around the boat.

What is needed, then, and is not found in the prior art, is a safe and efficient system for the dry storage of boats that is available at a reasonable cost for consumers of dry storage systems. The present invention satisfies that long felt need in a new, novel and unobvious manner.

SUMMARY OF THE INVENTION

The present invention is a dry stack watercraft storage system ("the storage system") created for storing and retrieving watercraft from a region of water. The storage system generally comprises a frame assembly, a rack assembly, and a cradle assembly. The frame assembly generally includes a pair of walls comprising crossed beams and pylons that serves as the shell of the storage system. The frame assembly also includes a series of support columns that stand parallel to the wall and provide support and protection of watercraft stowed in the storage system. The frame assembly further serves as a skeleton for wall skin, which can be a material of the builder's choice. The wall skin is attached directly to the exterior of the wall of beams and pylons to provide an external protection for the storage system.

The two sides of the frame assembly are joined together via a roof and a trolley bridge. The roof joins the walls, and the trolley bridge joins the support columns. The trolley bridge serves as the support for a trolley, and is comprised of two beams that extend between the support columns. The trolley is a standard bridge-crane trolley that is common to the manufacturing industry, and it controls movement of the watercraft within the storage system with three electric motors—a trolley motor for lateral movement of the cradle assembly, a cradle-lift motor that drives four winch cable lifts that provide vertical movement of the watercraft, and a bridge motor for longitudinal movement of the watercraft. The trolley is therefore able to move the watercraft from the center of the storage system into a specific module of the rack assembly.

The cradle assembly also includes at least four bumper assemblies that are used prevent the watercraft from leaving the cradle assembly during loading operations. Each bumper assembly has a bumper arm that extends diagonally down from the cradle beam towards the end of the cradle beam. The bumper arm is also joined to the cradle beam by a bumper spring, and at the end of the bumper arm is a bumper that extends upward and out towards the guide support runners. A roller is further connected to the top of the bumper. The bumper assembly is designed to allow a watercraft easy access on to the cradle assembly by allowing the bumper to be pushed down when a watercraft enters the cradle assembly and then returning to the original position once the watercraft is in the cradle assembly to keep the watercraft secured on top of the cradle assembly.

The rack assembly comprises a series of modules on the wall of the frame assembly for the placement of individual watercraft. The rack assembly includes a pair of padded cantilever beams, braces, and cable guides. The cantilever beams are firmly attached to the frame assembly and can be reinforced by the braces. The cantilever beams are configured to support a watercraft that is positioned on top of them. The distance between the cantilever beams is less than the width of the watercraft so as to provide adequate support of the watercraft. The rack assembly further includes at least one set of cable guides for each column of modules. The cable guides extend from the wall in an arcuate fashion to help position the watercraft in the correct column of cantilever beams. Furthermore, the cable guides aid in eliminating sway of the watercraft while it is being positioned on the cantilever beams.

The cradle assembly is the final major component of the storage system. The function of the cradle assembly is to provide support for the watercraft while it is being hoisted between the rack assembly and the water region. The cradle assembly includes a set of cradle beams, guide support runners, and cradle walls. The cradle beams function as a base platform for the watercraft, and are connected via two guide support runners and two cradle walls. The guide support runners extend upward from the cradle beams to support the watercraft. The cradle walls are connected at their respective lower edges to the ends of the cradle beams.

The cradle assembly further comprises a centering arm assembly that comprises at least one pair of centering arms and centering springs. The centering arm assembly aids in positioning the watercraft on the guide support runners while the centering assembly is immersed in the water. Each centering arm is connected to the cradle walls by the respective centering spring, and each centering arm is attached directly across from the other centering arm of the pair. The centering arms extend diagonally downward from the centering springs on the cradle walls toward the center of the cradle beams. The centering springs allow the centering arms to yield to the physical pressure that a watercraft might apply to them, but the centering springs also allow the centering arms to return pressure to the watercraft so as to direct the watercraft toward the center of the cradle assembly. Additionally, one end of a set of elastic bands may be attached to the cradle walls so that the other end of the bands can be attached to the watercraft to further aid the centering arm assembly in positioning the watercraft.

The cradle assembly is supported by at least four cables that are attached to the ends of the cradle walls. The cables connect the cradle assembly to the trolley that is positioned on the trolley bridge. Further, the cradle assembly comprises four counter weights that are connected beneath the ends of the cradle beams that allow for correct balancing of the watercraft and that allow the cradle assembly to carry the watercraft from the watercraft's center of gravity between the water region and the rack assembly.

The cradle assembly is designed to uniquely interact with the rack assembly to easily and quickly position the watercraft on the cantilever beams. The guide support runners are positioned in a peculiar manner on the cradle beams so that they are angled centrally toward each other. The distance between the guide support runners is precisely determined in that it is less than the width of the watercraft, yet it is greater than the distance between the pair of cantilever beams. This design allows the cantilever beams of the rack assembly to fit between guide support runners. Furthermore, the height of each guide runner is greater than the height of the cantilever beams so that the enclosed area defined between the two guide support runners, the cradle beams and the watercraft is sufficiently large for easy placement of the cradle assembly and watercraft around the cantilever beams.

Once the cradle assembly is positioned completely around the cantilever beams, the trolley lowers the cradle holding the watercraft past the cantilever beams. The watercraft is left on the cantilever beams, and the cradle assembly then exits the rack assembly to return to the water region to procure any additional watercraft or to a neutral location. Retrieval of the watercraft from the cradle rack assembly is done in reverse of the previously described method.

DESCRIPTION OF THE PREFERRED EMBODIMENTS

Figure 1:
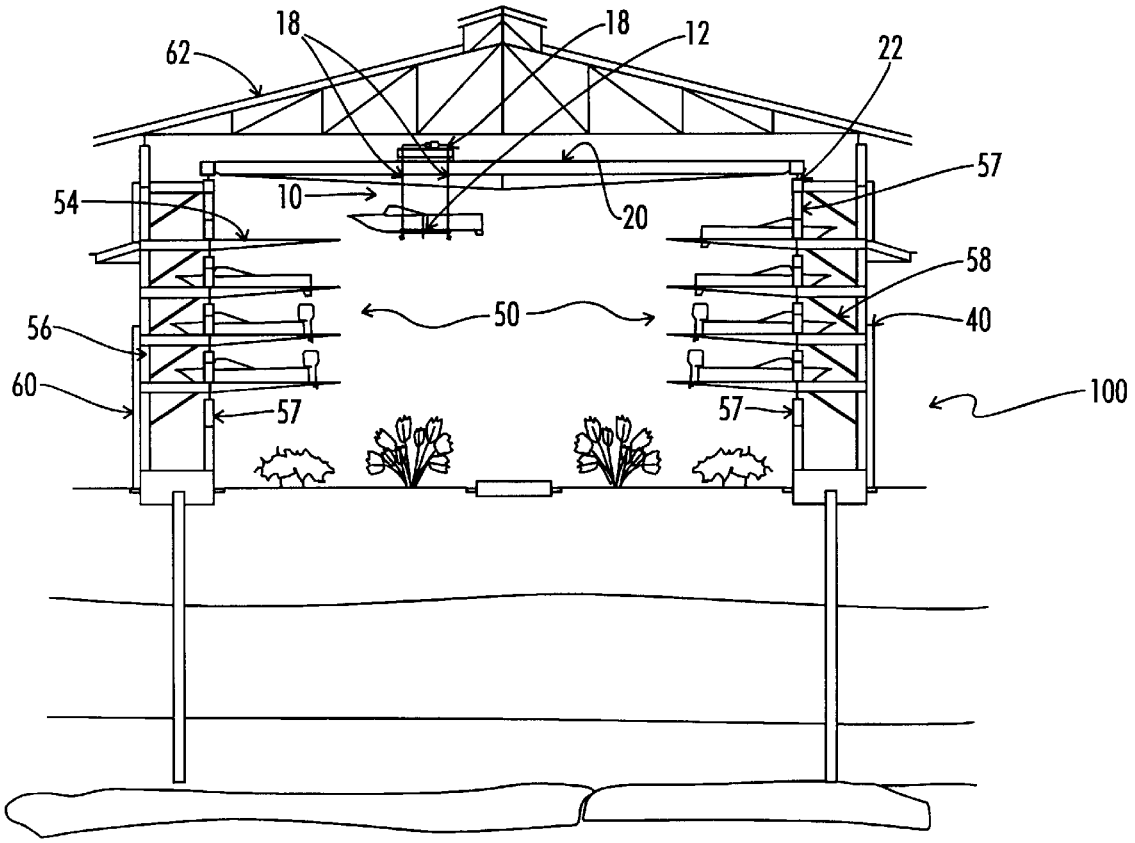
FIG. 1 is a cross section front view of the dry stack watercraft storage system.

An embodiment of the dry watercraft storage system ("the storage system") 100 is shown in FIG. 1. The storage system 100 is designed for storing and retrieving watercraft from a region of water within a system providing cantilevered racks for stowing watercraft. The storage system 100 generally comprises a frame assembly 40, a rack assembly 50, and a cradle assembly 10. The frame assembly 40 of the storage system 100 includes a wall 56 comprising beams and pylons intersecting at right angles and a series of support columns 57 that are positioned parallel to the wall 56. The frame assembly 40 provides support and protection of watercraft stowed in the storage system 100. The frame assembly 40 further serves as a skeleton for wall skin 60, which can be a material of the builder's choice. The wall skin 60 is attached directly to the exterior of the wall 56 of beams and pylons to provide an external protection for the storage system 100.

As is further shown in FIG. 1, the two sides of the frame assembly 40 are joined together via a truss 62 which is covered by any convenient roofing material. The truss 62 joins the walls 56 to provide stabilization to the storage system considering the weight of the system and the force put on the system by the cradle assembly as hereinafter described.

Figure 2:
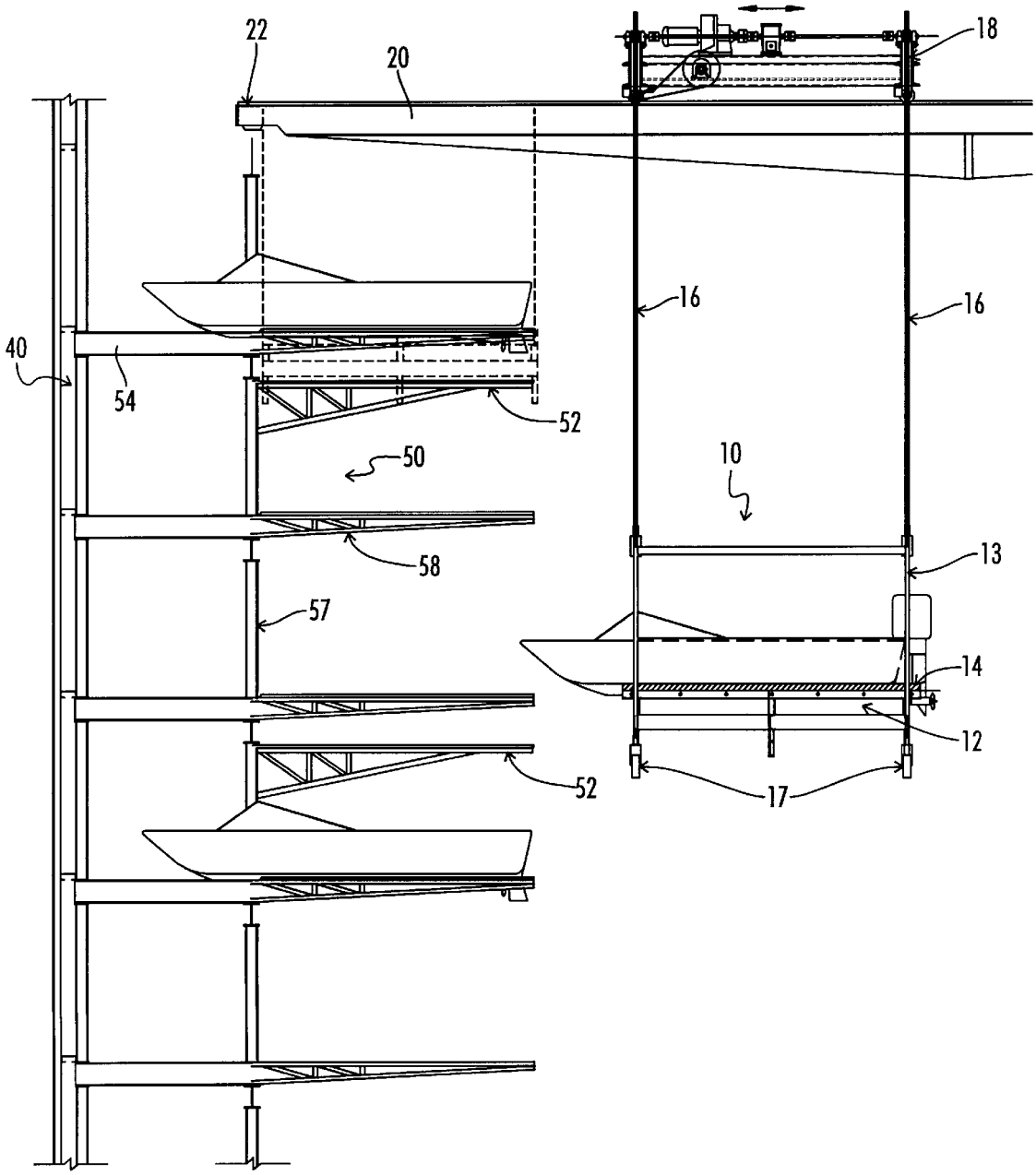
FIG. 2 is a partial front view of the dry stack watercraft storage system.
Figure 3:
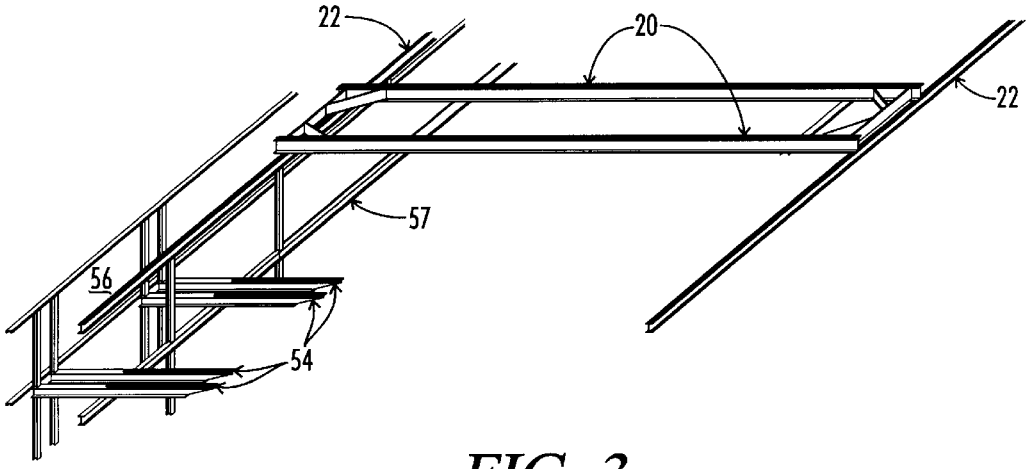
FIG. 3 is an exploded partial top view of the rack assembly and trolley bridge.

To load watercraft into the storage system 100, a trolley bridge 20 is connected between the support columns 57 (see FIGS. 2 and 3). The trolley bridge 20 includes a frame having two beams extending from one side of the storage system 100 to the other. The frame sits on bridge support beams 23 that are located on a track formed by a pair of rails 22, each rail running along a side of the building. The rails 22 are parallel and positioned at the top of the building near where the truss 62 joins with the support columns 57. The bridge support beams 23 are mounted on bridge wheels 28 which are aligned to roll along the rails 22 so that the trolley bridge 20 can be moved longitudinally in the building for placing the watercraft in a correct position to be inserted into a dry dock bay of the rack assembly 50.

The trolley 18 is mounted on a frame having trolley wheels 29 similar to the bridge wheels 28. These wheels are aligned to travel along the beams of the trolley bridge 20 so that the trolley 18 can be caused to travel laterally of the building. The features of the trolley bridge 20 just described are well known in the manufacturing industries and are readily available in the marketplace.

Figure 9:
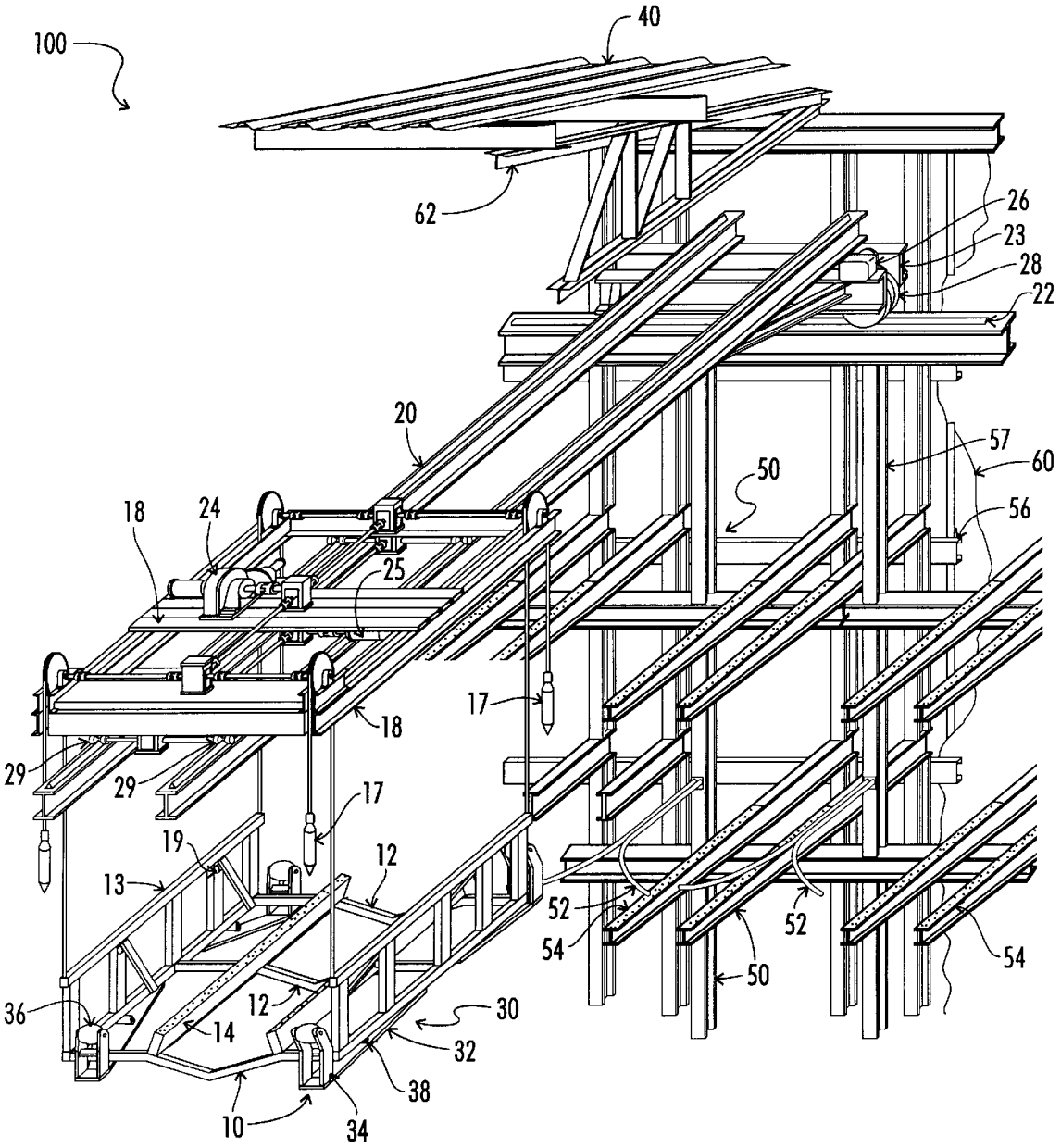
FIG. 9 is a plan view of the lift cradle system and the rack assembly.

The trolley bridge 20 also includes three separate motors (as shown in FIG. 9): a trolley motor 25 for causing the trolley to move laterally, a bridge motor 26 for causing the trolley bridge frame to move longitudinally and a cradle-lift motor 24 that drives four winch cable lifts that provide vertical movement of the cradle assembly 10. When a watercraft is positioned within the cradle assembly 10 as described in detail hereinafter, the trolley 18 can be manipulated to move the watercraft from the center of the storage system into a specific module of the rack assembly 50.

Looking at FIGS. 2 and 9, it can be seen that the rack assembly 50 forms a series of modules on the wall 56 of the frame assembly 40 for the placement of individual watercraft. The rack assembly 50 includes a pair of padded cantilever beams 54 that are firmly attached to the frame assembly 40 and can be reinforced by braces 58 if necessary.

The cantilever beams 54 are configured to support a watercraft that is positioned on top of them. The distance between the cantilever beams 54 is less than the width of the watercraft so as to provide adequate support for the watercraft.

Figure 4:
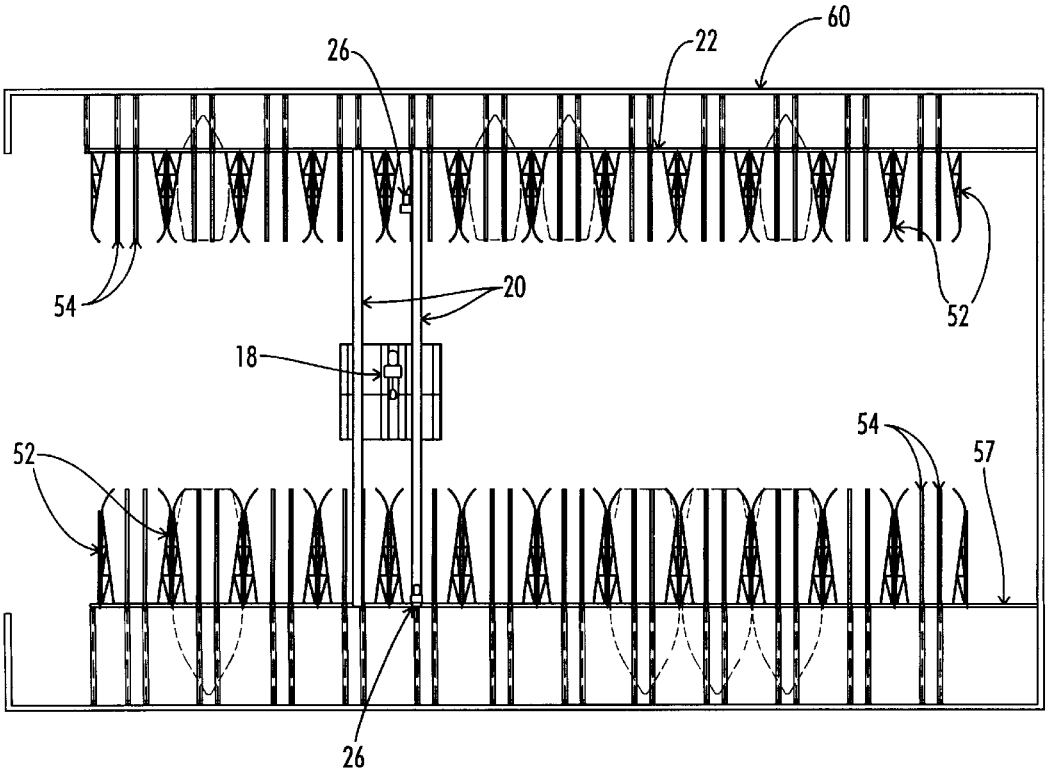
FIG. 4 is a top view of the dry stack watercraft storage system.

The rack assembly 50 further includes a set of cable guides 52 as shown in FIGS. 2 and 4. At least one set of cable guides 52 is positioned in each column of modules. The cable guides 52 are cantilevered from the wall 56 in an arcuate fashion with the unsupported ends being arched toward the center of the modules. The cable guides 52 are then able to help position the watercraft in the correct column of cantilever beams 54. Furthermore, the cable guides 52 aid in eliminating sway of the watercraft while the it is being positioned on the cantilever beams 54.

Figure 7:
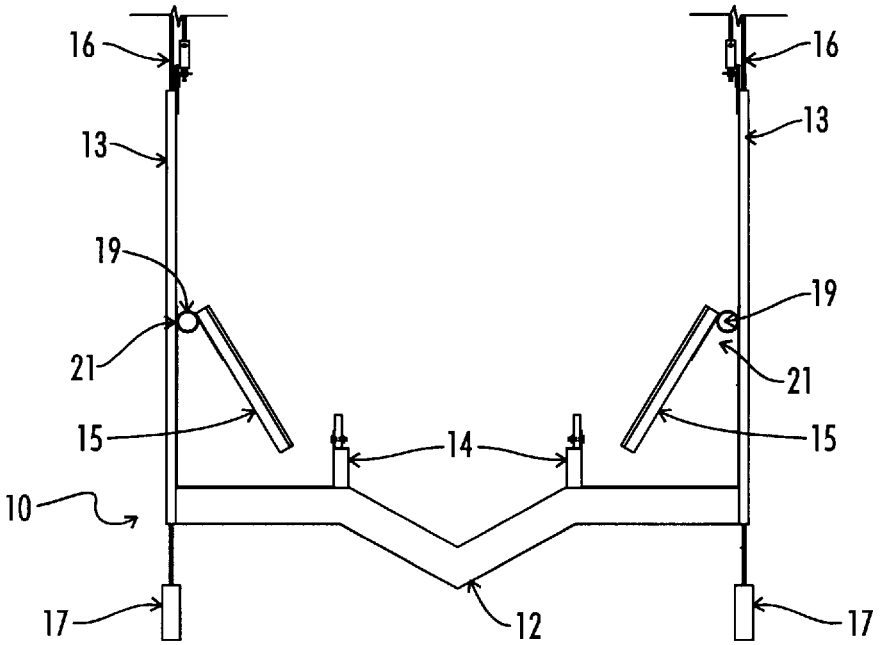
FIG. 7 is a front view of the cradle assembly.
Figure 8:
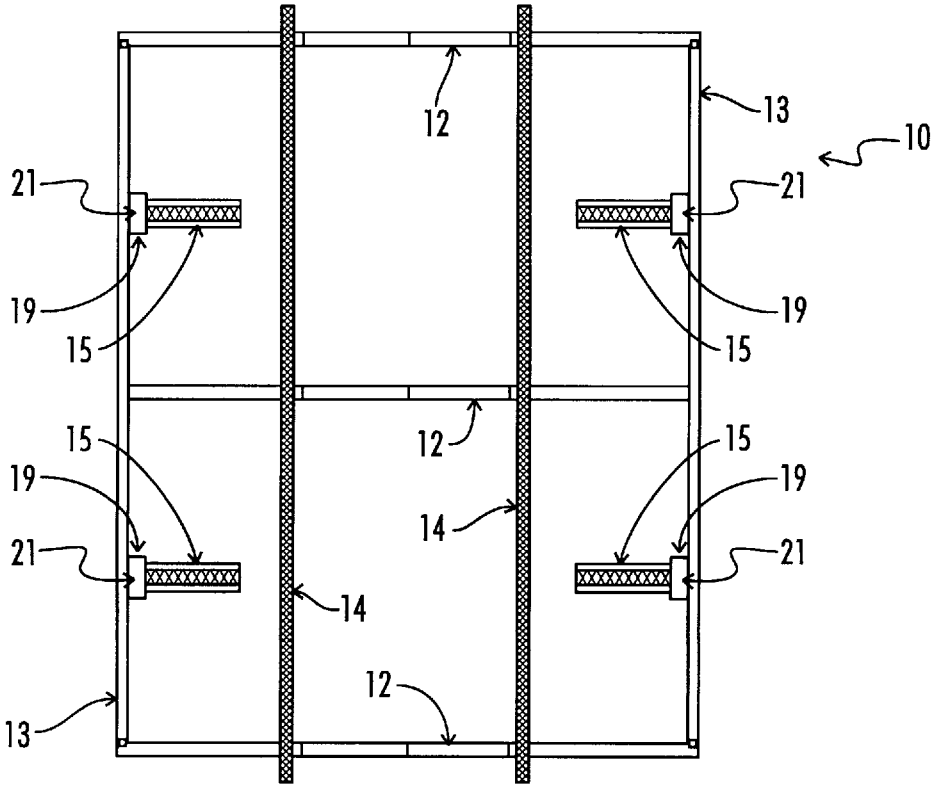
FIG. 8 is a top view of the cradle assembly.

The cradle assembly 10, shown in FIGS. 7 and 8, is the last major component of the storage system 100. The function of the cradle assembly 10 is to provide support for the watercraft while it is being lifted by its center of gravity between the water region and the rack assembly 50. The cradle assembly 10 comprises a set of cradle beams 12 that function as a base platform for the watercraft. The cradle beams 12 are connected via two guide support runners 14 and two cradle walls 13. The guide support runners 14 extend upward from the cradle beams 12 to support the watercraft as shown in FIG. 7. Also shown in FIG. 7, the cradle walls 13 are connected at their respective lower edges to the cradle beams 12.

The cradle assembly 10 also has a centering arm assembly 21 that includes at least one pair of centering arms 15 and springs 19, as shown in FIGS. 7 and 8. The centering arm assembly 21 aids in positioning the watercraft on the guide support runners 14 while they are submerged in the water. Each centering arm 15 is connected to the cradle walls 13 by a spring 19, and each centering arm 15 is attached directly across from the other centering arm 15 of the pair. They extend diagonally downward from the springs 19 on the cradle walls 13 toward the center of the cradle beams 12. The springs 19 allow the centering arms 15 to yield to the physical pressure that a watercraft might apply to them, but the centering arms 15 also return pressure to the watercraft to direct it toward the center of the cradle assembly 10. Furthermore, one end of a set of elastic bands (not shown) may be attached to the cradle walls 13 so that the other end may be attached to the watercraft to further aid the centering arm assembly 21 in positioning the watercraft.

Further, the cradle assembly 10 also includes at least four bumper assemblies 30 (shown in FIG. 9) that are used keep the watercraft from leaving the cradle assembly 10 during loading operations. Each bumper assembly 30 has a bumper arm 32 that extends diagonally down from the cradle beam 12 towards the end of the cradle beam 12. The bumper arm 32 is also joined to the cradle beam 12 by a bumper spring 38, and at the end of the bumper arm 32 that is not attached to the cradle beam 12 is a bumper 34 that extends upward and out towards the guide support runners 14. A roller 36 is further connected to the top of the bumper 34 to ease the entry of a watercraft. The bumper assembly 30 is designed to allow a watercraft easy access to the cradle assembly 10 by allowing the bumper 34 to be pushed down when a watercraft enters the cradle assembly 10 and then returning to the original position once the watercraft is completely in the cradle assembly 10 to keep the watercraft secured on top of the cradle assembly 10.

As shown in FIG. 9, the cradle assembly 10 is supported by at least four cables 16 in the preferred embodiment, although chains or any other type of rope capable of supporting the cradle assembly 10 could be used in place of cables 16. The cables 16 are attached to the ends of the cradle walls 13 and connect the cradle assembly 10 to the trolley 18 positioned on the trolley bridge 20. The cables 16 in the preferred embodiment extend directly straight down from the trolley 18 to the cradle assembly 10. However, the cables 16 may extend down from the trolley 18 to the opposing end of the cradle assembly 10 in a crosswise fashion. The cradle assembly 10 also has four counter weights 17 (shown in FIG. 9) that are connected to the free ends of the cables 16 to keep tension on the loose end of the cable 16 as it extends upward or downward in its vertical movement.

Figure 5:
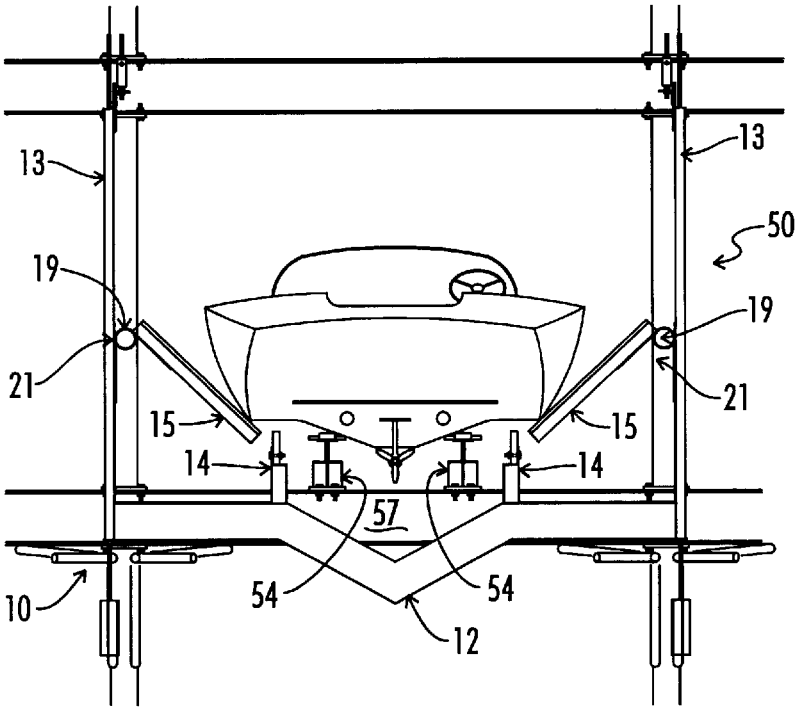
FIG. 5 is a front view of a cantilever rack module of the rack assembly and the cradle assembly with a watercraft being loaded in the cradle assembly.
Figure 6:
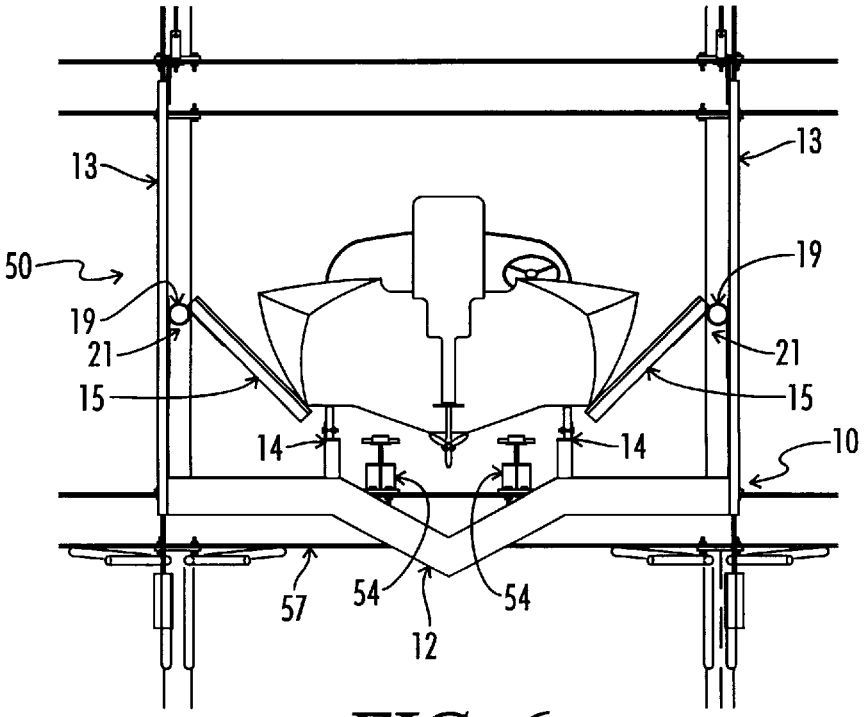
FIG. 6 is a front view of a cantilever rack module of the rack assembly and the cradle assembly with a watercraft being loaded in the rack assembly.

The interaction of the cradle assembly 10 with the rack assembly 50 is shown in FIGS. 5 and 6. The cradle assembly 10 is designed to uniquely work with the rack assembly 50 to easily and quickly position the watercraft on the cantilever beams 54. The cradle assembly 10 lifts from a center point within the cradle that corresponds with the center of gravity of the watercraft. The guide support runners 14 are positioned in a peculiar manner on the cradle beams 12 so that they are angled centrally toward each other, as shown in FIG. 9. The distance between the guide support runners 14 is precisely determined in that it is less than the width of the watercraft, yet it is greater than the distance between the pair of cantilever beams 54. This design allows the cradle beams 54 of the rack assembly 50 to fit between guide support runners 14. Furthermore, the height of each guide runner 14 is greater than the height of the cantilever beams 54 so that the enclosed area defined between the two guide support runners 14, the cradle beams 12 and the watercraft is sufficiently large for easy placement of the cradle beams 12 and watercraft above and below the cantilever beams 54.

Once the cradle assembly 10 is positioned completely around the cantilever beams 54 (as shown in FIG. 5), the trolley 18 lowers the cradle assembly 10 holding the watercraft past the cantilever beams 54. The watercraft is then left on the cantilever beams 54, and the drive of the motors of the trolley system is reversed to cause the cradle assembly 10 to exit the rack assembly 50 and return to a centrally located neutral position in the storage system 100. Retrieval of the watercraft from the rack assembly 50 is done in reverse of the previously described method.

Figure 10:
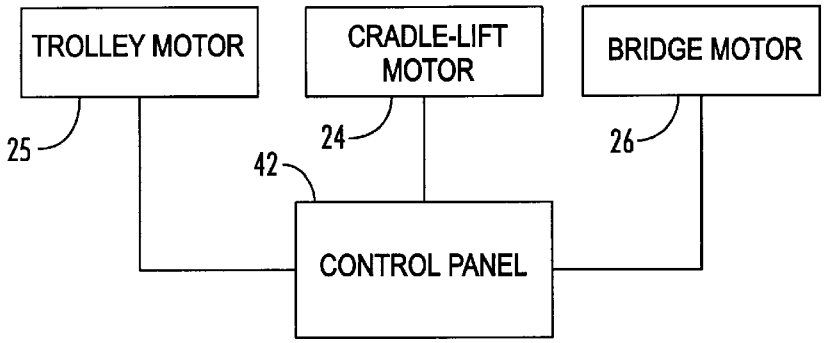
FIG. 10 is a block diagram of the automation system of the dry stack watercraft storage system.
Figure 11:
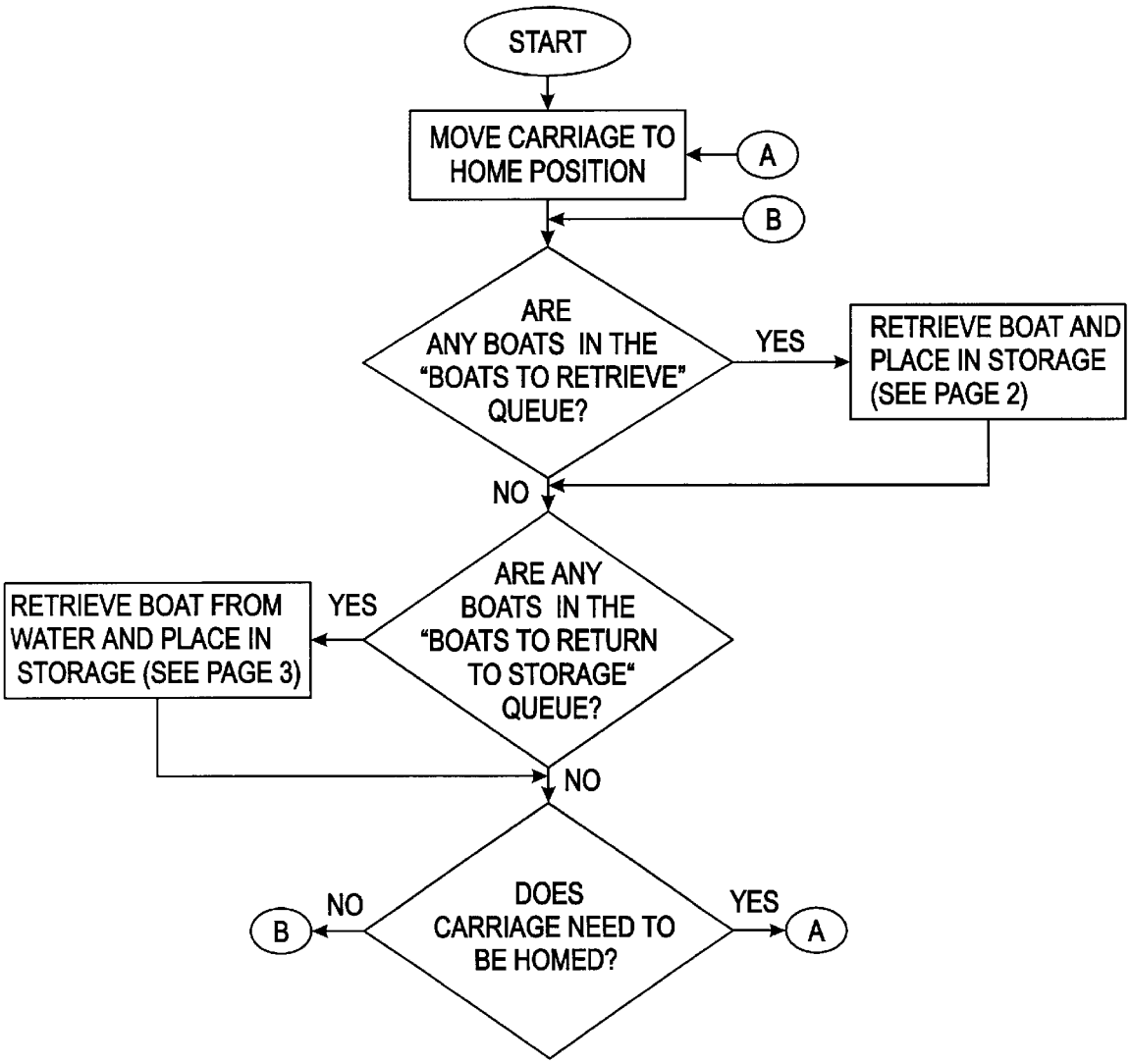
FIG. 11 is a flow chart of the algorithm used by the automation system to determine the motion used to position the cradle assembly.
Figure 12:
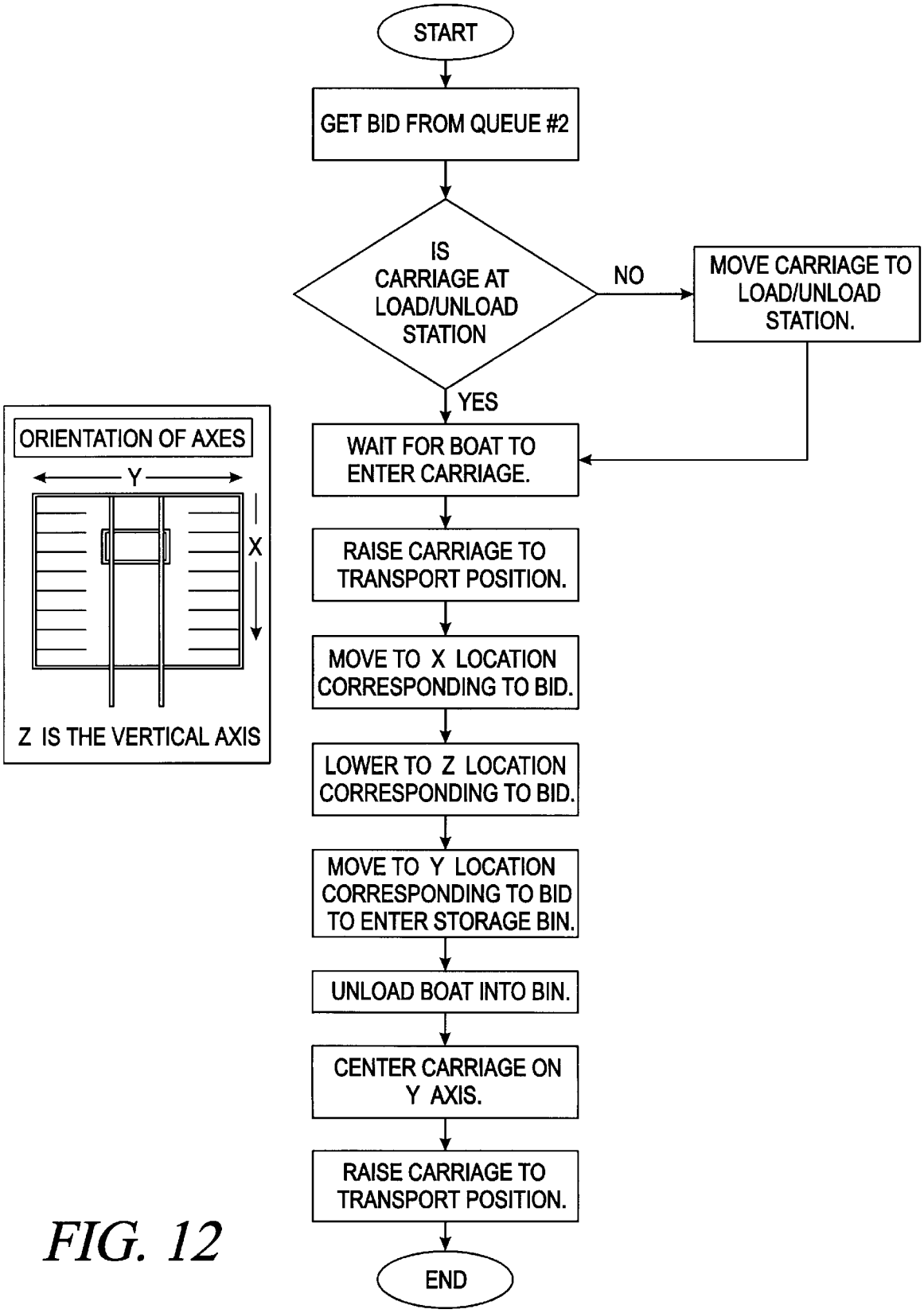
FIG. 12 is a flow chart of the algorithm used by the automation system of the dry stack watercraft storage system to place a watercraft on the rack assembly.
Figure 13:
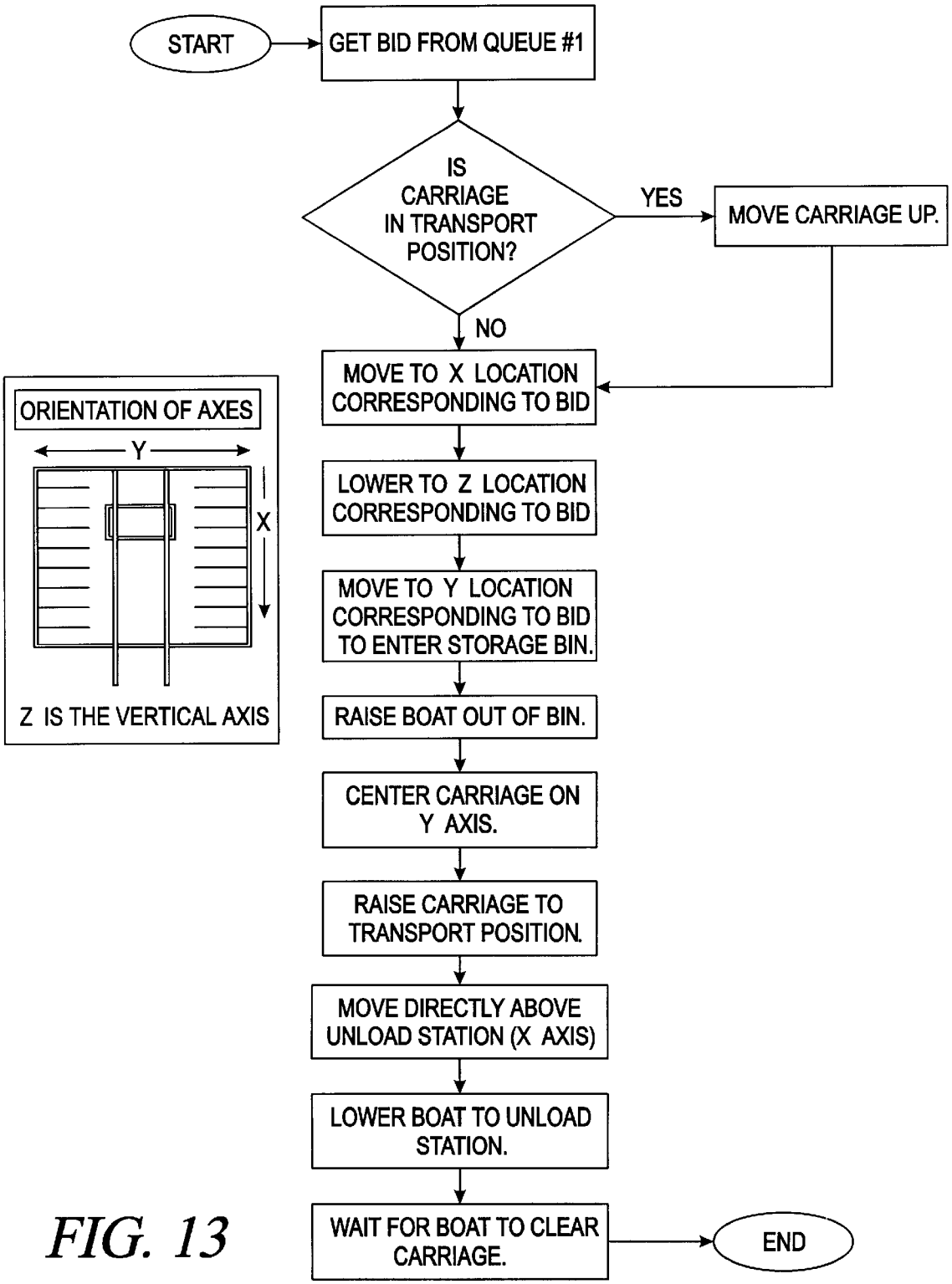
FIG. 13 is a flow chart of the algorithm used by the automation system of the dry stack watercraft storage system to remove a watercraft from the rack assembly and return to the loading station.

Because of the modular design of the cradle assembly 10 and storage performed on cantilever racks 54, the storage system 100 is easily automated to position and remove watercraft from the rack assembly 50 with minimal human interaction. Automation requires the adoption of specific coordinates for each module of the rack assembly 50 so that the coordinates denoting where a watercraft is to be deposit or retrieved can be specifically determined. With each module identified, the user can communicate the module coordinates to a standard personal computer (not shown) through a control panel 42 (shown in FIG. 10), which then controls the trolley motor 25, the cradle-lift motor 24, and the bridge motor 26 to determine where to position the cradle assembly 10 when moving a watercraft. The trolley 18, trolley bridge 20, and cradle assembly 10 can be further equipped with appropriate switches (light beam, laser controlled pressure or sail) (not shown) that will control starting and stopping of this invention. FIG. 11 illustrates the general algorithm used to determine whether a watercraft is to be moved. FIG. 12 further illustrates the algorithm used to move the watercraft from the water (or loading/unloading station) to the rack assembly 50. FIG. 13 illustrates the algorithm used to move the watercraft from the loading station to the rack assembly 50.

Also, because of the modular design of the frame of the storage system 100, it is possible for the facility to be based on land or floating on water. All that is required to create a floating storage system 100 is for the lowest modules of the rack assembly 50 that form the base of the storage system 100 to be equipped with a floatation device in addition to the columns and beams of the framework assembly 40.

Thus, although there have been described particular embodiments of the present invention of a new and useful Interactive Cradle and Cantilever Dry Stack Watercraft Storage System, it is not intended that such references be construed as limitations upon the scope of this invention except as set forth in the following claims.

What is claimed is:

1. A storage system for watercraft including a support wall, at least two watercraft support modules mounted to said support wall, said support modules being mounted and stacked in relationship to each other, said support modules each including a pair of cantilever beams having opposing ends, one of each set of opposing ends being attached to said support wall and the other end of each set of opposing ends cantilevering out from said support wall, a remote support unit spaced from said support wall in a direction of the other opposing ends of said beams and beyond the said other ends of said beams;

the storage system further including:

a bridge extending between said support wall and said remote support unit and a trolley mounted on said bridge for movement along said bridge, a cradle assembly for lifting and positioning said watercraft into the support modules, said cradle assembly including a pair of guide support runners and cradle beams, said cradle beams connecting said guide support runners, said guide support runners being spaced from each other a width less than a width of the watercraft to be placed on the cantilever beams, cables connecting said cradle beams and said trolley, a winch to wind the cables in order to lift the watercraft positioned within the cradle assembly and a trolley motor for driving said trolley laterally along said track to place the watercraft within the module.

2. The watercraft storage system of claim 1, wherein each guide support runner of the cradle assembly extends upward from the cradle beams at an angle toward the other guide runner of the pair.

3. The watercraft storage system of claim 2, wherein the guide support runners of the cradle assembly are padded for protected gripping of the watercraft.

4. The watercraft storage system of claim 3, wherein the cradle assembly further includes a cradle wall that extends upward from the cradle beams, the cradle wall being connected with the cables.

5. The watercraft storage system of claim 4, wherein the cradle assembly further includes a centering arm assembly attached to the cradle wall, the centering arm assembly comprising at least one pair of centering arms.

6. The watercraft storage system of claim 5, the centering arm assembly additionally comprising a pair of springs, the springs being attached to the cradle walls, each centering arm being connected to the respective spring and extending downward from the spring toward a center of the cradle assembly, the centering arm assembly serving to direct the watercraft to the center of the cradle assembly by applying pressure to sides of the watercraft.

7. The watercraft storage system of claim 5, wherein the cradle assembly includes a set of counter weights, the counter weights being attached to the cables at an end of said cables opposite an end of the cable attached to the cradle beams, the counter weights serving to offset the weight of the loose cables.

8. The watercraft storage system of claim 4, wherein the cradle assembly further includes a bumper assembly for holding the watercraft in the cradle assembly, the bumper assembly including a bumper, a bumper arm, and a bumper spring.

9. The watercraft storage system of claim 8, wherein the bumper assembly further includes a roller connected to said bumper.

10. The watercraft storage system of claim 1, wherein the storage system further includes a pair of cable guides positioned within each column of modules.

11. The watercraft storage system of claim 10, wherein a distance between the two cable guides is slightly less than a length of the cradle beams of the cradle assembly, the distance allowing each cable guide interacting with the respective pair of cables of the cradle assembly to direct the insertion of the cradle assembly around the column of modules, the cable guides making contact with the cables to prevent sway of the cradle assembly while the cradle assembly is positioning the watercraft on the cantilever beams.

12. The watercraft storage system of claim 11, the cable guides extending from the wall in an arcuate fashion with the unsupported end of each cable guide being arched toward a center of the column of modules.

13. The watercraft storage system of claim 1, wherein the cantilever beams of the support modules are padded for protected gripping of the watercraft.

14. The watercraft storage system of claim 13, wherein the storage system further includes a brace for each cantilever beam, each brace extending downward from the unsupported end of the cantilever beam back to the support column.

15. A watercraft storage system, the storage system comprising:

a storage building including a pair of support walls providing a framework of the building, each support wall including a series of vertical support columns and horizontal support beams, a rack assembly for supporting watercraft, the rack assembly being attached to the support walls, the rack assembly forming a plurality of adjoining individual modules, each module comprising a pair of cantilever beams having opposing ends, one end of each cantilever beam being rigidly secured to said wall and the other end cantilevering out from said wall a distance between said cantilever beams being less than a width of the watercraft;

a cradle assembly for transporting watercraft between a water region and the rack assembly, the cradle assembly comprising a set of cradle beams and a pair of guide support runners, the cradle beams being joined by the guide support runners, the guide support runners extending upward from the cradle beams, the distance between the guide support runners being less than the width of the watercraft but greater than the distance between the pair of cantilever beams, the guide support runners grasping the watercraft as the watercraft is moved between a water region and the rack assembly;

the watercraft storage system further comprising a trolley and trolley bridge for moving the cradle assembly both laterally and longitudinally, the cradle beams being linked to the trolley by at least four cables attached to ends of cradle walls.

16. The watercraft storage system of claim 15, wherein the cantilever beams of the rack assembly are padded for protected gripping of the watercraft.

17. The watercraft storage system of claim 16, the rack assembly further comprising a pair of braces, each brace extending downward from the cantilevered end of the cantilever beam back to the support column.

18. The watercraft storage system of claim 17, wherein the rack assembly further includes a pair of cable guides positioned within each column of modules.

19. The watercraft storage system of claim 18, wherein a distance between the two cable guides being slightly less than a length of the cradle beams of the cradle assembly, the distance allowing each cable guide interacting with the respective pair of cables of the cradle assembly to direct insertion of the cradle assembly around the column of modules, the cable guides making contact with the cables to prevent sway of the cradle assembly while the cradle assembly is positioning the watercraft on the cantilever beams.

20. The watercraft storage system of claim 19, wherein the cable guides extend from the support wall in an arcuate fashion with an unsupported end of each cable guide being arched toward a center of the column of modules.

21. The watercraft storage system of claim 15, wherein the guide support runners of the cradle assembly are padded for protected gripping of the watercraft.

22. The watercraft storage system of claim 21 wherein the cradle assembly further includes a cradle wall that extends upward from the cradle beams, the cradle wall being connected with the cables.

23. The watercraft storage system of claim 22, wherein the cradle assembly further includes a centering arm assembly comprising at least one pair of centering arms.

24. The watercraft storage system of claim 23, the centering arm assembly additionally comprising a pair of springs, the springs being attached to the cradle walls, each centering arm being connected to the respective spring and extending downward from the spring toward a center of the cradle assembly, the centering arm assembly serving to direct the watercraft to the center of the cradle assembly by applying pressure to sides of the watercraft.

25. The watercraft storage system of claim 23, wherein the cradle assembly further includes a bumper assembly for holding the watercraft in the cradle assembly, the bumper assembly including a bumper, a bumper arm, and a bumper spring.

26. The watercraft storage system of claim 25, wherein the bumper assembly further includes a roller connected to said bumper.

27. The watercraft storage system of claim 25, the cradle assembly further comprising a set of counter weights, the counter weights being attached to the cables at an end of said cables to offset weight of loose cables.

* * * * *